United States Patent [19]

Benjamin et al.

[11] 4,456,484

[45] Jun. 26, 1984

[54] PROCESS FOR PRODUCING REFRACTORY POWDER

[75] Inventors: Mary L. Benjamin, Athens; Robert J. Dobbs, Monroeton; Mary E. Shaffer, Towanda, all of Pa.

[73] Assignee: GTE Products Corporation, Stamford, Conn.

[21] Appl. No.: 520,094

[22] Filed: Aug. 4, 1983

Related U.S. Application Data

[63] Continuation-in-part of Ser. No. 365,685, Apr. 5, 1982, Pat. No. 4,397,889.

[51] Int. Cl.[3] ..... B22F 1/02

[52] U.S. Cl. ..... 75/252

[58] Field of Search ..... 75/0.5 BC, 0.5 BB, 252

[56] References Cited

U.S. PATENT DOCUMENTS

| | | | |
|---|---|---|---|
| 2,501,128 | 3/1950 | Kerr | 75/0.5 BC |
| 3,988,524 | 10/1976 | Dreyer et al. | 75/252 |
| 4,106,932 | 8/1978 | Blachford | 75/252 |
| 4,320,156 | 3/1982 | Oakes et al. | 75/252 |

*Primary Examiner*—W. Stallard

*Attorney, Agent, or Firm*—Robert E. Walter

[57] ABSTRACT

A pressable and sinterable metal carbide grade powder consists essentially of a uniform mixture of a refractory metal carbide powder, a metal binder powder, and from about 0.5 to about 5 percent by weight of an organic amide having a melting point greater than about 120 degrees centigrade.

1 Claim, No Drawings

PROCESS FOR PRODUCING REFRACTORY POWDER

This application is a continuation-in-part of U.S. application Ser. No. 365,685 entitled Process for Producing a Refractory Powder, filed Apr. 5, 1982, now U.S. Pat. No. 4,397,889.

The present invention relates to refractory powders, and particularly to refractory metal carbide grade powders of the type containing particles of refractory metal carbide, a binder metal and an organic binder.

BACKGROUND OF THE INVENTION

Grade powders are pressed and sintered to form cemented carbide articles such as drill tools, cutting bits and wear parts. Grade powders comprise a mixture of fine powders of metal carbides and a binder metal. A wax binder may be included in the grade powder to promote the flowability of the grade powder into die cavities, to aid in pressing by a lubricating action, and to impart sufficient green strength to permit handling after pressing.

Prior to sintering, the wax binder is typically removed during the step known as "dewaxing" by heating in a furnace at a temperature of from about ambient to 500° C. in a protective atmosphere or vacuum.

As set forth in U.S. Pat. No. 4,070,184 to Scheithauer et al. a process is described wherein water is used as a milling fluid and a water soluble, long chain polyvinyl alcohol is added to the milled slurry of metal carbide and binder metal after milling but prior to spray drying. According to this process, the wax-like binder is water soluble or compatible with water to ensure adequate distribution of the wax in the grade powder.

Paraffin type waxes which are insoluble in water are typically incorporated into grade powders by use of an organic solvent which dissolves the paraffin wax so that good dispersion of the wax in the powder is assured. The organic fluid is removed by several drying methods to give a wax containing grade powder. Due to the flammability of organic solvents, if spray drying is used, a closed cycle spray drying system is required which utilizes an oxygen free atmosphere such as nitrogen. Generally, this system is characterized by a high initial cost as compared to a water system which can be an open system.

In the water system, water is the milling liquid and a water soluble binder is utilized. The water system is clearly desirable from a safety standpoint as compared to the organic system. However, the water system is indesirably limited to the types of waxes that can be used since the waxes must be compatible with the system to adequately disperse the wax in the powder for achieving desired powder properties.

It is desirable to develop systems for waxing grade powders which permit more flexibility in the utilization of waxes.

SUMMARY OF INVENTION

In a process for producing a refractory metal carbide grade powder according to parent U.S. patent application, Ser. No. 365,685, filed Apr. 5, 1982, a metal carbide powder is heated above melting point of an organic binder prior to forming a blended mixture of metal carbide and organic binder which is subsequently milled with a metal binder in liquid milling medium incompatible with the organic binder and the mixture is dried to form a powder.

During the drying process, using the aforementioned process, the powder tends to deposit on the walls of the dryer chamber. The wall deposits deplete the amount of wax available for mixing and necessitate costly equipment cleaning. Accordingly it has been found that the organic binder may be selected to obivate the above discussed problems.

In accordance with the present invention, there is provided a pressable and sinterable metal carbide grade powder consisting essentially of a uniform mixture of a refractory metal carbide powder, a metal binder powder, and from about 0.5 to about 5 percent by weight of an organic amide having a melting point greater than about 120 degrees centigrade.

DETAILED DESCRIPTION

Grade powders which may be prepared by the process of the present invention are intimate mixtures of refractory metal carbide powders plus a metallic cementing phase or matrix called a metal binder. Generally the grade powders include an organic binder which also serves as a pressing lubricant. A typical grade powder is a mixture of tungsten carbide, cobalt, and paraffin wax. The carbide powder may consist of other carbides or mixtures thereof and are generally the refractory carbides which include carbides of the metals from the Groups IV, V and VI of the Periodic Table that have a melting point above about 1895° C. Cobalt is the most common matrix for tungsten carbide. Nickel, iron, and molybdenum, either singularly or in combination, particularly in combination with cobalt are typically used when refractory metal carbides other than tungsten carbide are used. For example, the matrix phase for titanium carbide is typically either nickel or a nickel-molybdenum alloy. As used herein, the matrix metal is selected from the iron group of metals and alloys of the iron group of metals.

The amount of binder metal or matrix metal may be from about 2 to about 90 percent by weight of the total weight of refractory carbide and matrix metal. From about 5 to about 20 percent is more typical.

The average particle size of the refractory metal carbide is generally from slightly less than one micron to about 25 microns. The most common tungsten carbide generally is between 1 to 2 microns. Grain inhibitors and other additives may typically be employed in the grade powder mix. Materials commonly used are molybdenum carbide, vanadium carbide and chromium carbide. The refractory metal particles may be conveniently blended with the metal binder particles to form a blended powder mixture. It is also contemplated that additions of binder metal or metal carbide particles may be performed during subsequent mixing operations.

Grade powders may be processed by any suitable method known in the art to produce a hard body that is particularly desirable for use as the working surfaces of tools. Typically sintered metal carbide bodies are prepared by pressing the grade powder in hard steel or carbide lined steel molds at pressures usually ranging from 5 to 30 tons per square inch depending on the size and shape of the compact. Sintering is then performed usually at temperatures ranging from 1350° to 1500° C. for times of from about 30 to 60 minutes. Sintering is generally performed in a protected or non-oxidizing atmosphere.

One type of wax utilized are insoluble in water. Typical water-insoluble waxes are low-melting mixtures or compounds of high molecular weight which are solid at room temperature and generally similar in composition to fats and oils. The waxes are thermoplastic and possess the properties of water repellency, smooth texture, and repellency, smooth texture, and nontoxicity. The major types of waxes include animal wax such as bees wax, spermaceti, lanolin, and shellac wax. The vegetable waxes include carnauba, candelilla, and others. Mineral waxes include earth waxes such as ceresin and petroleum waxes such a paraffin. Various synthetic waxes include ethylenic polymers, polyol ether-esters, chlorinated naphthalenes and various hydrocarbon waxes. Of the water-insoluble waxes petroleum waxes such as paraffin waxes are preferred. The water-insoluble waxes are typically soluble in organic solvents such as acetone.

Another type of waxes utilized are insoluble in organic solvents. Typical organic solvent-insoluble waxes include polyglycol, polyethylene glycol, hydroxyethylcellulose, tapioca starch, and carboxymethylcellulose. Some of the organic-insoluble waxes may be soluble in water.

In accordance with the present invention, metal carbide particles which may include metal binder particles are heated to a temperature above the melting point of the wax and intimately or thoroughly mixed to form a substantially uniform blend of heated carbide powder and wax. Preferably the temperature is at least about 20 degrees centigrade and more preferably about 30 degrees centigrade above the melting point of the wax. The temperature should be below the decomposition temperatures of the wax. Generally longer mixing times tend to give a better dispersion of the wax in the powder. The metal carbide particles and wax should be sufficiently mixed so that the particles are at least partially coated with or imbedded in the wax. If metal binder particles are present with metal carbide particles, the mixing should be carried out in a non-oxidizing environment, i.e. inert atmosphere or vacuum to prevent the oxidation of the metal binder. The amount of wax typically used should be sufficient to impart green strength to a pressed compact. Increased amounts of wax up to a certain level tend to increase the green strength of a compact. The amount of wax varies according to the type of desired grade powder. The amount of wax employed is typically from about 0.5 to about 5 percent by weight based on the total weight of the final grade powder.

Next the uniformly blended mixture of wax and metal carbide is preferably cooled. The cooling promotes adherence of wax to particles. Tumbling during cooling aids in obtaining smaller clumps of mix. Cooling also reduces tendency of metal binder oxidation.

Milling the resulting blended metal carbide containing wax and metal binder powder is an important feature of the present invention. If metal binder is not present during the heating and mixing of wax and metal carbide particles, metal binder particles are added either prior to or during milling to produce a milled mixture of metal carbide, metal binder and wax. The milling of relatively coarse fraction of refractory material is often desirable to reduce the powder to a particle size suitable for sintering. When the refractory material is a metal carbide, compactability of alloy powders is improved by milling with a metal binder. The milling mixture is milled with a liquid milling medium to produce a slurry. The liquid milling medium is selected so that the wax is insoluble therein. The hereinbefore waxes insoluble in water may be used when water is a milling fluid. When other waxes hereinbefore mentioned are used, an incompatible or insoluble fluid is utilized.

Preferably the milling is attritor milling. Attritor milling aids in rapidly dispersing the metal binder throughout the powder. The time required to properly disperse the metal binder particles or reduce the particle size during attritor milling is dependant on the particular attritor mill used, the type of powders used, the speed of the mill and various other factors. Generally it has been found that times as short as one hour are sufficient to properly disperse the particles and obtain a desirable size reduction.

After the appropriate milling time, the slurry is discharged from the mill. This may require additional milling fluid to thin the slurry and rinse the mill. During discharge, the slurry may be passed through a 100 mesh screen to permit the removal of any contamination than may have been introduced form the milling balls. Milling fluid may be decanted from the screened slurry to obtain the desired solids concentration for spray drying. Generally, this ranges from 70–90% by weight. It is desirable to avoid using excess milling fluid during milling so that the drying step may be carried out without prior decanting or filtering.

Spray drying may be carried out using commercially available spray drying equipment. The inlet and outlet air temperatures should be maintained below about 370° C. and 190° C., respectively, to prevent substantial oxidation or decarburization of the slurry constituents. The spray drying is carried out under conditions to produce an agglomerated powder mixture consisting essentially of agglomerated particles of metal carbide, metal binder and wax. Typically the size range of the agglomerated particles is from about 20 to about 150 microns. During spray drying, the slurry is generally heated to about 50° C. and agitated. A suitable spray dryer is a Protco-Schwartz spray dryer with two-fluid-top nozzle atomization. When water is the milling fluid, typical drying parameters may be an air pressure of 20 psi, drying temperature of 200°–230° C. and an outlet temperature of 100°–130° C. When organic solvents are used as the milling fluid, the spray drying is preferably performed in absent air. Spray drying temperatures are dependent on the volatility of the solvent. The spray dried agglomerates may be classified by screening to obtain a desired fraction.

Although spray drying is the preferred method of drying, it is contemplated that other drying methods which produce an agglomerate or a non-agglomerate may be utilized. The milling fluid may be conveniently evaporatively removed at a temperature below the decomposition temperature of the organic binder. When it is desirable to produce a non-agglomerated powder, the milled refractory powder and binder may be tumbled during evaporative drying to prevent formation of agglomerates. The drying should be carried out to such an extent that substantially all the milling fluid is removed from the powder. The powder consists essentially of refractory particles, organic binder and intentional additives.

According to the principles of the present invention, the organic amide binders which may be derived from long chain fatty acids are insoluble in water and only slightly soluble in some organic solvents at room temperature. The preferred liquid milling medium preferably comprises water. Preferably the melting point of the amide binder is greater than 120 degrees centigrade and preferably from about 130 to about 150 degrees centrigrade.

The amount of amide binder varies as a weight percent of the final powder mixture according to constituents and desired properties of the final grade powder. Preferably the amount of amide binder employed is sufficient to give an amide binder content in final grade powder of from about 0.5 to about 5 percent by weight. The final powder which is a substantially uniform blend consists essentially of refractory metal carbide powder, metal binder powder and organic amide binder with intentional additives such as grain growth inhibitors and other unintentional ingredients which do not substantially or unduly effect the desirable pressability and sinterability properties of the grade powder.

To more fully illustrate the invention, the following example is presented. All parts, proportions, and percentages are by weight unless otherwise indicated.

EXAMPLE 1

About 169 kilograms of tungsten carbide powder is placed in a Ross double-planetary mixer equipped with a heating/cooling jacket. The tungsten carbide powder is pre-heated to a temperature of 165° C. About 3.6 kilograms of synthetic amide wax, Kinco wax 278-V, is added. The wax which is insoluble in water is obtained from Kindt Collins Co. and has a melting point of about 135° C. The mixing is continued for about 5 minutes after addition of the wax while the temperature is maintained at about 160° C. The wax-metal carbide mixture is mixed additionally while the mixer is changed to a cooling mode and the powder mixture is cooled to room temperature. About 25 liters of deionized water is placed in an attritor mill and the mill is rotated at slow speed. The waxed metal carbide powder and 10.8 kilograms of cobalt metal powder are slowly added and dispersed in the milling solution. The mill is then rotated at high speed, about 100 r.p.m. for about ½ to 3 hours. The slurry is removed from the mill and transferred to a holding tank where it is agitated prior to spraying. The spray drying results in the formation of agglomerated particles of metal carbide, metal binder and wax which are suitable for pressing into compacts and sintering.

EXAMPLE 2

The procedure of Example 1 is repeated using Rosswax-160 which is a synthetic amide wax supplied by the Frank B. Ross Co., Inc., with similar results.

What is claimed is:

1. A pressable and sinterable metal carbide grade powder consisting essentially of a uniform mixture of a refractory metal carbide powder, a metal binder powder, and from about 0.5 to about 5 percent by weight of an organic amide having a melting point greater than about 120 degrees centigrade.

* * * * *